US008499826B2

(12) United States Patent
Hillis et al.

(10) Patent No.: US 8,499,826 B2
(45) Date of Patent: Aug. 6, 2013

(54) INTELLIGENT PRESSURE ACTUATED RELEASE TOOL

(75) Inventors: Parry B. Hillis, Spring, TX (US); Garry R. Kaiser, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 346 days.

(21) Appl. No.: 12/966,452

(22) Filed: Dec. 13, 2010

(65) Prior Publication Data

US 2012/0145403 A1 Jun. 14, 2012

(51) Int. Cl.
*E21B 34/06* (2006.01)

(52) U.S. Cl.
USPC ..... 166/66.6; 166/319

(58) Field of Classification Search
USPC ..... 166/377, 383, 66.6, 66.7, 319
See application file for complete search history.

(56) References Cited

U.S. PATENT DOCUMENTS

| | | | | |
|---|---|---|---|---|
| 4,043,410 | A | 8/1977 | Bennett et al. | |
| 4,658,896 | A | 4/1987 | Milam | |
| 4,880,060 | A * | 11/1989 | Schwendemann et al. | 166/336 |
| 4,949,788 | A | 8/1990 | Szarka et al. | |
| 5,718,291 | A * | 2/1998 | Lorgen et al. | 166/377 |
| 5,967,231 | A | 10/1999 | Laurel et al. | |
| 6,148,916 | A | 11/2000 | Sampson et al. | |
| 6,263,968 | B1 | 7/2001 | Freeman et al. | |
| 6,408,946 | B1 | 6/2002 | Marshall et al. | |
| 6,571,871 | B2 | 6/2003 | Lauritzen et al. | |
| 6,591,912 | B2 | 7/2003 | Ross et al. | |
| 6,712,146 | B2 * | 3/2004 | Estep et al. | 166/377 |
| 6,880,637 | B2 | 4/2005 | Myers, Jr. et al. | |
| 7,013,979 | B2 | 3/2006 | Richard | |
| 7,240,734 | B2 | 7/2007 | Nivens et al. | |
| 7,387,165 | B2 | 6/2008 | Lopez de Cardenas et al. | |
| 7,395,862 | B2 | 7/2008 | Ross et al. | |
| 7,503,390 | B2 | 3/2009 | Gomez | |
| 7,686,082 | B2 | 3/2010 | Marsh | |
| 7,775,758 | B2 | 8/2010 | Legare | |
| 2006/0131030 | A1 | 6/2006 | Sheffield | |
| 2008/0041597 | A1 | 2/2008 | Fisher et al. | |
| 2011/0011643 | A1 | 1/2011 | Phillips | |

OTHER PUBLICATIONS

Simon P. Benavides, William D. Myers, Edgar W. Van Sickle and Kristian Vargervik (Baker Hughes Incorporated), Advances in Horizontal-Oriented Perforating Optimize Perforation Efficiency and Production While Maintaining Borehole Stability, SPE Production and Operations Symposium, Mar. 22-25, 2003, D SPE 80929.

Simon P. Benavides, William D. Myers, Edgar W. Van Sickle and Kristian Vargervik (Baker Hughes Incorporated), "Advances in Horizontal Oriented Perforating", SPE Latin American Caribbean D Petroleum Engineering Conference, Apr. 27-30, 2003, SPE 81051.

Simon P. Benavides, William D. Myers, Edgar W. Van Sickle and Kristian Vargervik (Baker Hughes Incorporated), "Advances in Horizontal Oriented Perforating Optimize Perforating and Production While Maintaining Borehole Stability" SPE Asia Pacific Oil and Gas Conference and Exhibition, Sep. 9-11, 2003, D SPE 80443.

* cited by examiner

*Primary Examiner* — William P Neuder
(74) *Attorney, Agent, or Firm* — Steve Rosenblatt

(57) ABSTRACT

A pressure pulse signal is processed and a valve is operated to allow tubing or annulus pressure to move a piston against an atmospheric or low pressure chamber. Movement of the piston triggers the release of the dogs that previously held two components together for a separation. Redundant release mechanisms that respond to discrete pressure pulse signals are provided for backup purposes.

17 Claims, 1 Drawing Sheet

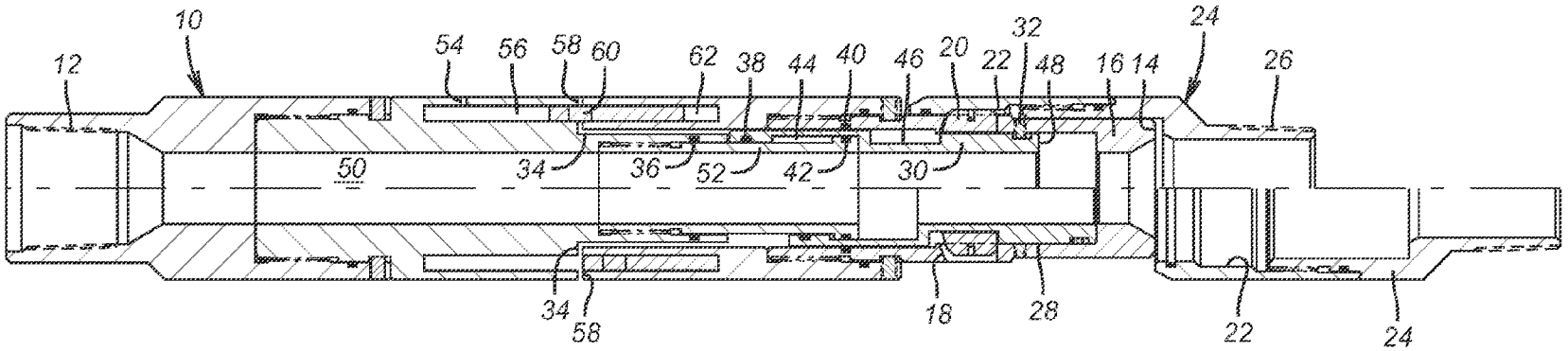
24
26
24
22
14
16
48
28
32
22
20
18
30
46
40
42
44
38
52
62
36
60
58
58
34
34
56
54
50
10
12

INTELLIGENT PRESSURE ACTUATED RELEASE TOOL

FIELD OF THE INVENTION

The field of the invention is tubular string disconnects and more particularly those controlled from the surface with a signal such as a pressure pulse pattern that results in valve movement making tubing or annulus pressure available to undermine at least on dog to allow disconnection.

BACKGROUND OF THE INVENTION

Disconnects are used downhole to release from a tool once it is set. If a work string delivering a tool gets stuck before or after delivery of a tool it is also advantageous to be able to release from the tool so that the string can be removed. After the string is removed a fishing or milling tool can be deployed to remove the stuck tool or portion of the string below the disconnect.

The two components are selectively held engaged against tension by one or more retainers such as dogs that extend through a window in one component into a recess in an opposing component and selectively held in that position by a sleeve or piston. An example of such a disconnect is U.S. Pat. No. 7,395,862 which has a dog 56 or U.S. Pat. No. 6,148,916 using a disconnect in the context of releasing a perforating gun where the release actuates the gun to fire.

Some tools release by applied tensile force above a predetermined value and can be locked against release at that value or unlocked using a remote signal such as an acoustic signal so that if the predetermined tension is then applied the connection will release. An example of this general design in an application of a fail-safe disconnect from a subsea well is U.S. Pat. No. 7,240,734, notably the unlatch tool 28. U.S. Pat. No. 6,880,637 uses hydrostatic pressure to actuate a release mechanism for a perforating gun. An electronic firing head responds to sonic signals to fire the gun. U.S. Pat. No. 6,591,912 shows the use of gas pressure developed from shooting off a perforating gun to actuate a release mechanism. U.S. Pat. No. 5,967,231 releases a wiper plug and delivers a signal that the plug has been released. US publication 2008/0041597 combines in a single assembly a release feature and a data gathering and transmission feature using a variety of telemetry techniques such as pressure pulses, acoustic or electromagnetic signals as described in paragraph 63.

The present invention operates a disconnect using preferably a pressure pulse signal that is processed at the disconnect. Upon receipt of the predetermined release signal a valve is operated to allow either annulus or tubing fluid pressure act against a piston on one of its ends with the opposite end preferably exposed to a low pressure or atmospheric chamber or tubing pressure. The piston movement breaks a shear pin and positions a recess opposite a locking dog to enable the separation of the two previously held components. Activation can come from the tubing or the annulus or both. The piston can be an annular sleeve or one or more rods. Piston movement can also be used in other applications to open or close a tubular wall port. Those skilled in the art will gain further insight into the present invention from a review of the detailed description of the preferred embodiment and the associated FIG. while recognizing that the full scope of the invention can be found in the appended claims.

SUMMARY OF THE INVENTION

A pressure pulse signal is processed and a valve is operated to allow tubing or annulus pressure to move a piston against an atmospheric or low pressure chamber. Movement of the piston triggers the release of the dogs that previously held two components together for a separation. Redundant release mechanisms that respond to discrete pressure pulse signals are provided for backup purposes. Alternative applications for opening or closing a tubular wall port or an inline valve such as during drill stem testing are envisioned.

BRIEF DESCRIPTION OF THE DRAWING

The FIGURE is a split view with the connection intact on one side and separated on the other side.

DETAILED DESCRIPTION OF THE PREFERRED EMBODIMENT

The FIGURE illustrates an upper housing 10 having a connection thread 12. Upper housing 10 has a lower end 14 at bottom sub 16 that has a plurality of openings or windows 18 through which extend retaining dogs 20. The dogs 20 also extend into a groove 22 of housing 24 that has connection threads 26. When the dogs 20 extend into groove 22 and are supported by surface 28 of piston 30 the housings 10 and 24 are secured to each other. Initially, a shear pin or pins 32 can also hold the housings 10 and 24 together. Pressure applied in passage 34 acts on the top of the piston 30 and that pressure is sealed with seals 36, 38, 40 and 42. Seals 38 and 42 define a low pressure or atmospheric chamber 44 that aids in movement of piston 30 when triggered to move.

Piston 30 has a recess 46 designed to accept the dogs 20 when moved into alignment with the dogs 20 as shown in the bottom of the FIG. Such movement of the piston 30 will initially break the shear pin or pins 32. Note that the lower end 48 is exposed to tubing pressure in the passage 50 but can alternatively be directed into another low pressure or atmospheric chamber by a reconfiguration of the bottom sub 16. Housing 10 has a lower extension 52 to define the cavity for the piston 30. Although piston 30 is illustrated as a sleeve from its top near seal 38 to its lower end at the connection for the shear pin 32 other structures for the piston 30 are envisioned. The upper end above groove 46 can be one or more rods that are actuated in tandem or independently with redundant systems as will be explained below. Each rod can have a discrete port to within or outside the housings and the same or different signals to the processor 56 can allow pressure to reach discrete rods to create a release using tubing or annulus pressure. While release of the dogs 20 is illustrated with axial movement of the piston 30 other movements are envisioned that can remove support for the dogs 20 by moving surface 28 away from dogs 20. Rotation of the piston to bring recess 46 in registry with dogs 20 is also contemplated as well as other movements that combine axial and rotational piston 30 movements.

Housing 10 has a port 54 that is preferably directed to the surrounding annulus for the communication of predetermined pulses of a particular magnitude and duration in a sequence that will be recognized by one or more battery operated processors referred to generally as 56 and located within a wall of the housing 10. A communication port 58 is shown leading from the surrounding annular space to a valve 60. Valve 60 operation is controlled by the processor 56. While one valve 60 is illustrated there can be more such valves and they can direct fluid from the surrounding annulus or the tubing passage 50 to passage or passages 34 to drive a single annularly shaped piston 30 or a series of rod pistons against an annularly shaped lower end of the piston 30 that has the recess or recesses 46. The processor 56 is capable of distinguishing several predetermined signals to drive different valves 60 either one at a time for alternative actuation of the piston 30 or to operate a plurality of valves 60 at the same time for an enhanced force applied to the piston 30 to effect a release of the dogs 20 so that housings 10 and 24 can separate.

The lower part of the FIG. shows the recess 46 in registry with dogs 20 that allows the dogs 20 to retract from groove 22 of housing 24 so that housing 10 can be removed with the tubing string connected at thread 12. Groove 22 also serves as an attachment point for a fishing spear (not shown) that can engage the housing 24 if for any reason it needs to be fished out.

Valve 60 can be a sleeve that is released for movement by the processor 56 such that passage 34 is in communication with passage 58 as the sleeve moves against a low pressure or atmospheric chamber 62 as shown in the lower part of the FIG. where the separation has already occurred. Alternatively, valve 60 can be a ball or a plug valve or other designs suitable for on and off service.

Those skilled in the art will appreciate that what is illustrated is a disconnect that can be triggered with a signal in a variety of forms that can be recognized by a processor to then employ pressure in the annular space around the tool or in the tubing passage within the tool to get a piston moving to allow a connection to separate. There can be a single signal that is recognized to allow the separation or discrete signals so that alternative opportunities are available to trigger the release. One or more openings to annulus or tubing pressure can be provided that are opened to the same or different processed signals. The actuating piston can be shifted axially or rotated or it can undergo some combination of movements to undermine the dogs that hold the connection together. The transmitted signal can be a pressure pulse through annulus or tubing sides or it can be an acoustic signal through the tubular wall or other signal delivered using fiber-optic cable or electrical or magnetic fields to mention a few alternatives. Movement of the piston can be aided or completely driven by providing an opposed end of the piston configured to be exposed to a low pressure or atmospheric pressure chamber in the housing component in which it is disposed. Depending on the orientation of the inlet passage to the piston 30 the annulus pressure or the tubing pressure can also be increased from the surface to aid in the movement of the piston after the processor 56 opens one or more valves 60. The same groove that was used to hold the components together with a dog or dogs can also after the separation be used to fish the lower component that remained in the wellbore after the component separation. The valve 60 can be retained by the processor against a pressure differential between port 58 coming from outside or inside said housings and chamber 62 until a release is needed. The processor can free the valve member, which can be an annular ring to move to expose passage 34 to tubing or annulus pressure or both depending on the configuration so that the dogs 20 get undermined by movement of piston or actuator 30 to release housing 10 from housing 24. The housing components can be splined or otherwise prevented from relative rotation when held together with dogs 20.

The illustrated preferred application for a disconnect can be adapted to open or close a tubular wall port or to open or close an inline valve such as a ball valve or another type for a safety or operational feature such as during a drill stem test.

The above description is illustrative of the preferred embodiment and many modifications may be made by those skilled in the art without departing from the invention whose scope is to be determined from the literal and equivalent scope of the claims below.

We claim:

1. An intelligent disconnect tool for selective release of housing components from each other in a subterranean location, comprising:

overlapping first and second housings with a selectively supported retainer engaging said housings to retain them together;

an actuator to selectively support said retainer, said actuator selectively exposed to pressure from within or from outside said housings and additionally exposed to a pressure lower than within said housings or outside said housings;

at least one valve to selectively expose pressure from within or outside said housings to said actuator for movement of said actuator to release said retainer holding said housings together.

2. An intelligent disconnect tool for selective release of housing components from each other in a subterranean location, comprising:

overlapping first and second housings with a selectively supported retainer engaging said housings to retain them together;

an actuator to selectively support said retainer, said actuator selectively exposed to pressure from within or from outside said housings and additionally exposed to a pressure lower than within said housings or outside said housings;

at least one valve to selectively expose pressure from within or outside said housings to said actuator for movement of said actuator to release said retainer holding said housings together;

a processor mounted to at least one of said housings to receive at least one remotely generated signal to open said valve.

3. The tool of claim 2, wherein:

said processor responds to a plurality of discrete signals to open said valve.

4. The tool of claim 2, wherein:

said at least one valve comprises a plurality of valves;

said processor opens said valves with a common signal or each valve with a discrete signal.

5. The tool of claim 2, wherein:

said signal comprises pressure pulses.

6. The tool of claim 2, wherein:

said valve comprises an annular member subject to a pressure differential and released to move by said processor to open pressure access to said actuator from within or outside said housings.

7. The tool of claim 2, wherein:

said actuator is selectively exposed to pressure outside said housings.

8. The tool of claim 2, wherein:

said actuator is exposed to pressure inside said housings.

9. The tool of claim 2, wherein:

said actuator comprises at least in part an annular shape having a support surface for said retainer and at least one recess that allows said retainer to exit at least one of said housings when aligned with said retainer.

10. The tool of claim 9, wherein:

said annular shape defines a low pressure chamber with one of said housings, said low pressure chamber containing initially pressure lower than within or outside said housings and said low pressure chamber is reduced in volume on motion of said annular shape to align said recess with said retainer.

11. The tool of claim 9, wherein:

said actuator comprises at least one rod extending from said annular shape and having an opening in one of said housings communicating to an end of said rod to pressure from within or outside said housing.

12. The tool of claim 9, wherein:

said retainer comprises at least one dog supported on said support surface and extending through an opening in one of said housings into a groove in the other of said housings.

13. The tool of claim 12, wherein:

said dog retracting out of said groove in the other of said housings when said recess of said annular shape aligns with said dog.

14. The tool of claim 13, wherein:

said annular shape moves axially in one of said housings.

15. The tool of claim 14, wherein:

said axial movement of said annular shape initially breaks a shear pin extending into said one housing and said annular shape.

16. The tool of claim 15, wherein:

said groove is said another of said housings provides a grip location for a fishing tool that retrieves it after separation of said housings.

17. The tool of claim 2, wherein:

said housings are rotationally locked when held together by said retainer.

* * * * *